United States Patent [19]

Carver

[11] 3,933,346

[45] Jan. 20, 1976

[54] CLAMPING OR GRIPPING DEVICES

[75] Inventor: Leonard John Carver, Little Haywood, England

[73] Assignee: Carver & Co. (Engineers), Walsall, England

[22] Filed: Apr. 1, 1974

[21] Appl. No.: 456,497

[30] Foreign Application Priority Data

Apr. 17, 1973 United Kingdom ..... 18402/73

[52] U.S. Cl. ..... 269/4; 269/88; 269/150; 269/157; 269/188; 269/235; 269/239

[51] Int. Cl.[2] ..... B25B 1/02; B25B 1/08

[58] Field of Search ..... 269/147, 150, 157, 188, 269/166–171.5, 196–206, 214, 215, 235, 236, 239, 274, 3, 4; 24/263 R, 263 LL, 263 B; 81/128

[56] References Cited

UNITED STATES PATENTS

| | | | |
|---|---|---|---|
| 757,166 | 4/1904 | Wintsch, Jr. | 269/170 |
| 1,948,134 | 2/1934 | Rose et al. | 269/205 |
| 2,619,138 | 11/1952 | Marler | 269/215 |
| 2,701,492 | 2/1955 | Johnson | 269/221 X |
| 3,033,559 | 5/1962 | Lindholm | 269/205 |
| 3,817,510 | 6/1974 | Jatcko | 269/321 ME |
| 3,836,136 | 9/1974 | Davis | 269/201 |

*Primary Examiner*—Roy Lake
*Assistant Examiner*—Neil Abrams
*Attorney, Agent, or Firm*—John C. Smith, Jr.

[57] ABSTRACT

A clamping or gripping device comprises a handle by which the device can be held in one hand to position it relatively to the work, a carrier mounted or mountable on the handle, or on a part on the handle, a first jaw carried by the handle, and a second jaw pivotally mounted on the carrier. The carrier is movable along the handle, or along a part on the handle, to move the second jaw bodily towards and away from the first jaw; and there is pivotally mounted on the carrier a lever so arranged that, when the device is being held by the handle in one hand to position it relatively to the work, the lever is movable by the same hand, as that which is holding the handle, in a direction towards the handle to cause leverage to be exerted on the second jaw to cause clamping or gripping pressure to be applied, against the work, in the direction of the first jaw.

9 Claims, 8 Drawing Figures

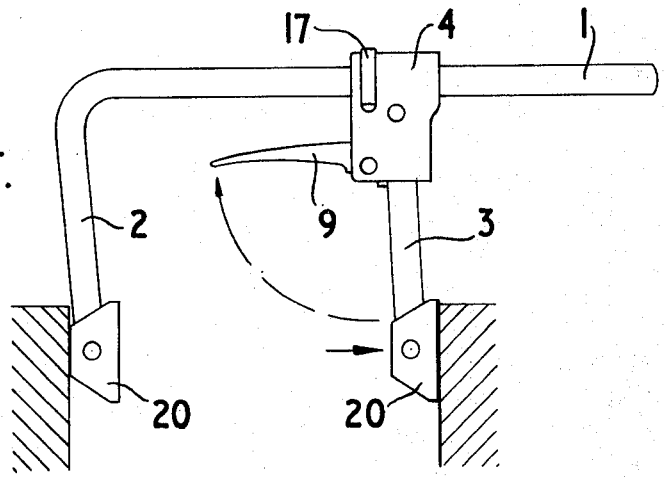
FIG. 5.
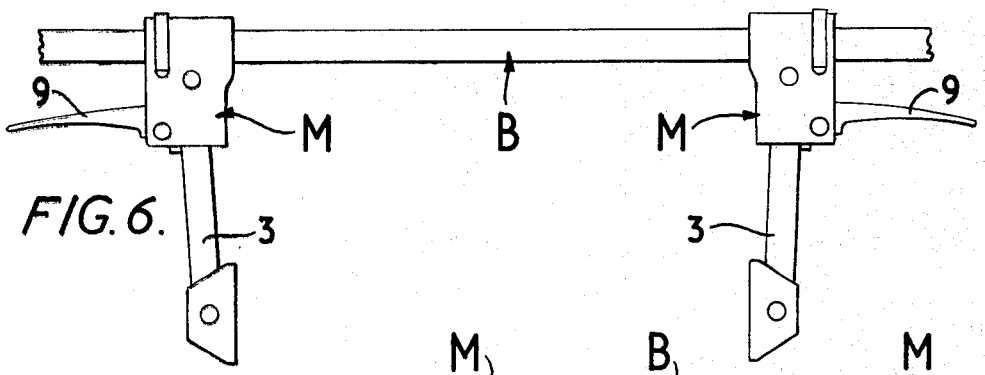
FIG. 6.
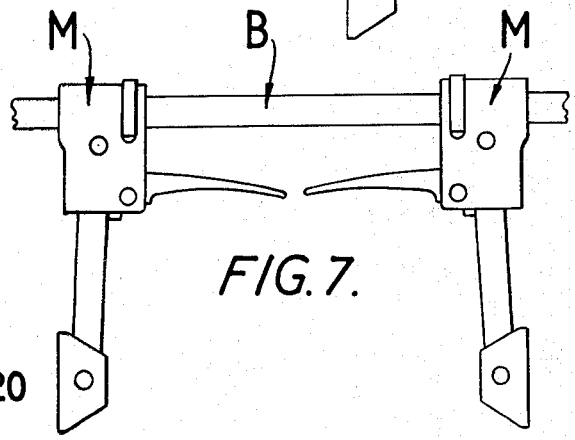
FIG. 7.
FIG. 8.
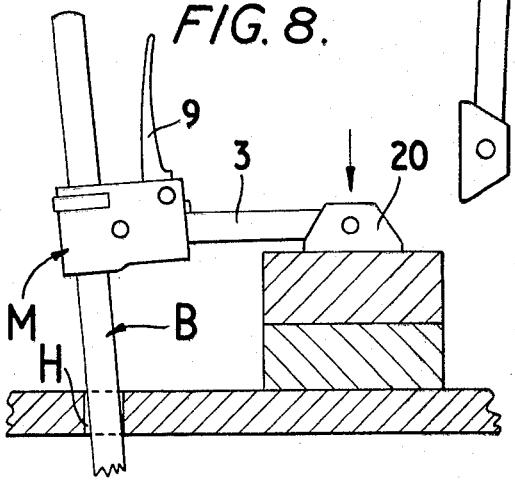

CLAMPING OR GRIPPING DEVICES

This invention relates to a clamping or gripping device of that kind having a first jaw, a pivotable second jaw bodily movable towards said first jaw to engage work on which clamping or gripping pressure is to be exerted, and means operable to cause said second jaw, when engaged with the work, to tend to turn whereby to cause clamping or gripping pressure to be applied, against the work, in the direction of the first jaw.

A known clamping device of this kind comprises a first jaw carried by a frame member, a second jaw slidable along the frame member to engage the work and able to pivot relatively to the frame member, and means, manually operable from behind the frame member, to cause the second jaw to tend to turn relatively to the frame member, whereby to exert a final clamping pressure against the work. However, a disadvantage of this known construction is that when the device is being held in, or steadied by, one hand to position it relatively to the work, the operator will need to use his other hand to operate the means for causing the second jaw to exert a final clamping pressure against the work, so that he does not, at the time he operates said means, have a hand free to hold, or adjust the position of, the work itself.

According to the invention, a clamping or gripping device comprises a handle by which the device can be held in one hand to position it relatively to work to be clamped or gripped, a carrier mounted, or mountable, on the handle or on a part on the handle, and two opposed jaws extending, in use, laterally of the handle and comprising a first jaw which is in, or is securable in, stationary relationship relatively to the handle, and a second jaw pivotally mounted on the carrier, said carrier being movable along the handle or a part on the handle to move the second jaw bodily towards, or in a direction away from, the first jaw and said carrier having pivotally mounted thereon a lever which is so arranged that, when the device is being held by the handle in one hand to position it relatively to the work, said lever is movable by the same hand, as that which is holding the handle, in a direction towards the handle to cause leverage to be exerted on the aforesaid second jaw to cause clamping or gripping pressure to be applied, against the work, in the direction of the first jaw. Preferably, movement of the lever towards the handle causes a part of, or turning with, the lever to cam against a part of, or bearing on, the second jaw, whereby to cause leverage to be exerted on said second jaw to tend to turn the latter towards the first jaw to apply clamping or gripping pressure. The lever may have an inner end having a cam edge engaging a thrust block in turn engaging a longitudinal edge of the second jaw, and an opposite longitudinal edge of said second jaw may engage a rubber pressure pad acting between a surface or surfaces of the carrier and said pad-engaging longitudinal jaw-edge, whereby said pressure pad is compressed, as the lever is turned to cause leverage to be exerted on said second jaw. Preferably, the carrier is slidable against frictional resistance along the handle, said frictional resistance holding the carrier against sliding out of an adjusted position under the action of gravity. The carrier may have mounted therein a part or moulding of plastics material which, in use, frictionally engages the handle and holds the carrier against sliding out of an adjusted position under the action of gravity. The handle may be slidably engaged at one side by a rear wall of the carrier or a part on or against said wall, and at the other side by the inner end of the second jaw. The first jaw may be an integral extension of the handle. Both jaws may have, pivoted to their outer ends, terminal parts or pads for engaging the work to be clamped or gripped, said pivoted terminal parts or pads being angularly movable relatively to the jaws whereby, to the extent permitted by their range of angular movement, to have a self-aligning capability relatively to the work. Said terminal parts or pads may be of low-friction material.

The carrier, with the second jaw and the lever pivotally mounted thereon, may constitute components of a unit removable from the handle and replaceable on the handle in a reversed position to enable the device to be used to apply expansive force.

Also, according to the invention, a movable-jaw unit suitable for use as part of a clamping or gripping device of a construction set forth in the third paragraph of this Specification comprises a carrier constructed to accept, and slidably engageable with, a handle or bar, a jaw pivotally mounted on said carrier, and a lever pivotally mounted on said carrier and so arranged that, when the carrier is mounted on the bar or handle, said lever is, by a hand holding or gripping the bar or handle, movable in a direction towards the bar or handle to cause leverage to be exerted on the pivoted jaw.

Further, according to the invention, a kit of parts comprises a pair of movable-jaw units of a construction set forth in the last preceding paragraph, at least one fixed-jaw unit comprising a fixed jaw secured to, or integral with, a handle of bar form with which either of said movable-jaw units is slidably engageable in either of two mutually-reversed positions relative to the fixed jaw to form a two-jaw device, and a bar with which, selectively, (a) both movable-jaw units are slidably engageable in either of two mutually-reversed positions to form a two-jaw device the jaws of which can be set further apart than in the case where one of said movable-jaw units is engaged with said fixed-jaw unit, and (b) a single one of said movable-jaw units is slidably engageable.

In the accompanying drawings:

FIG. 5 shows a movable-jaw unit, of the assembly in FIG. 1, in a reversed position; and FIGS. 6, 7 and 8 show some different arrangements which may be set up utilising a kit of parts including a pair of movable-jaw units each constructed in accordance with the invention and a plain length of bar.

Figure 1:
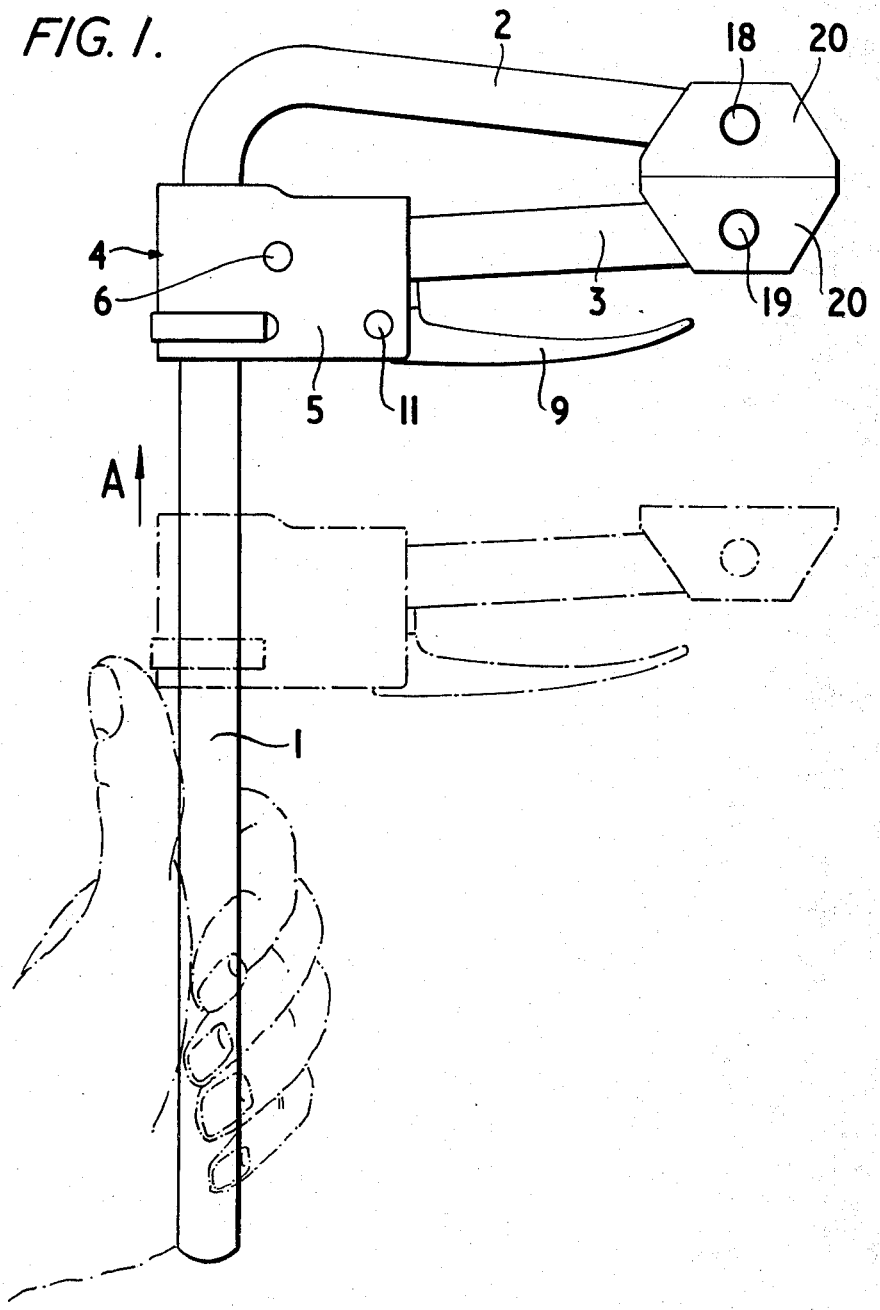
FIG. 1 shows, in side view, and by way of example, a clamping device constructed in accordance with the invention.
Figure 2:
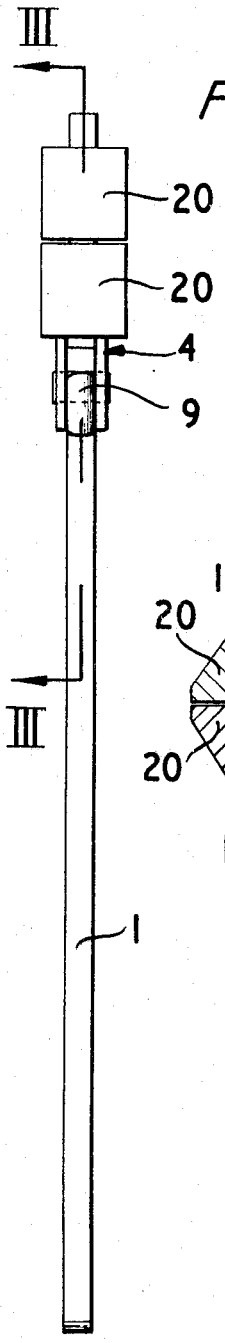
FIG. 2 is an edge view of the device shown in FIG. 1.
Figure 3:
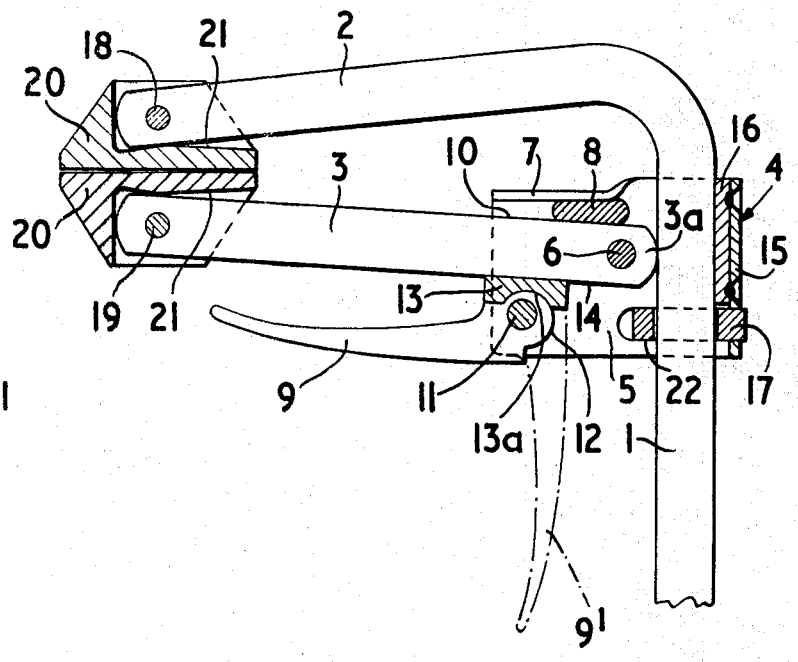
FIG. 3 is a sectional view on the line III—III, FIG. 2.
Figure 4:
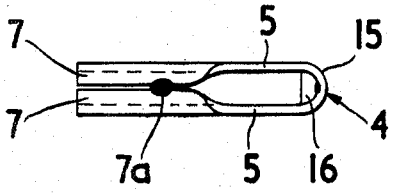
FIG. 4 is a plan view of a carrier and insert of the device shown in FIGS. 1 to 3.

Referring to FIGS. 1 to 4 of the drawings, the clamping device shown therein may be used, for example, in the light engineering field and by amateurs or hobbyists working at home on constructional projects, and comprises a handle 1 in the form of a straight steel or alloy steel bar, and first and second jaws, designated 2 and 3 respectively, which are also of steel or alloy steel and which extend laterally from the handle 1. The first jaw 2 is fixed in relation to the handle 1, being constituted by an integral extension of said handle 1.

Slidably mounted on the handle 1 is a sheet-metal carrier 4, of a U-form in cross-section, having a pair of spaced side walls 5. The aforesaid second jaw 3 is pivotally mounted on the carrier 4, being connected to the latter by, and fulcrummed about, a pivot pin 6 mounted at its ends in the said carrier walls 5. The carrier 4 has a pair of opposed inturned top flanges 7 welded together at 7*a* and integral with front portions of the carrier side walls 5. Engaging between these flanges 7 and a longitudinal top edge 10 of the pivoted second jaw 3 is a rubber pressure pad 8. Also pivotally mounted on the carrier 4 is a trigger-shaped lever 9 connected to the carrier 4 by, and fulcrummed about, a pivot pin 11 spaced beneath the pivoted second jaw 3 and, like the pin 6, mounted at its ends in the walls 5. The lever 9 is a zinc die-casting. The inner end of the lever 9 is formed with a cam edge 12 which engages against an aluminium thrust block 13 disposed between said cam edge 12 and a longitudinal bottom edge 14, opposite to the aforesaid top edge 10, of the pivoted jaw 3. The block 13 slidably engages the said jaw edge 14 at a location spaced forwards of the jaw pivot 6, and has a recess 13*a* having a curved face engaged by, and locating the said block 13 upon, the cam edge 12. The lever 9 is so mounted in relation to the handle 1 that a hand grasping the said handle 1 can at the same time readily turn the said lever 9 towards the handle 1 from an inoperative position, shown in full lines in FIG. 3, to an operative position.

The carrier 4 has, inserted against and welded to a rear wall 15 of said carrier, a D-sectioned metal insert 16 slidably engaging the rear side of the handle 1 when the carrier is slid along the handle, and the rear end, 3*a* of the pivoted jaw 3 slidably engages, opposite to the part 16, the front side of said handle 1 when the carrier is slid along the handle. The said carrier 4 has mounted in a slot 22 therein a moulding 17, of plastics material, which engages the surface of the handle 1 and offers frictional resistance to the sliding of the carrier 4 along the handle, said resistance being arranged to be sufficient to prevent the carrier 4, with the jaw and other parts thereon, from sliding down the handle under the action of gravity.

The outer end of each jaw, 2 or 3, has pivotally mounted thereon, by pivot pins 18, 19, respectively, a clamping pad 20 of a material having a low coefficient of friction. Each pad 20 is slotted at the end to receive the respective jaw end and has an obtuse-angled interior surface 21 which permits a certain amount of tilting movement of the pad relatively to the respective jaw, whereby when, in use, the pads 20 are engaged with the parts to be clamped they have, to the extent permitted by their range of tilting movement, a self-aligning capability relatively to the parts to be clamped. The pads 20 may be of low friction acetal plastics material. The moulding 17 can conveniently also be of said acetal plastics material, since although said material is low-friction material, it can provide sufficient frictional resistance to prevent the carrier 4, with the jaw and other parts thereon, sliding down the handle under the action of gravity.

A convenient method of using the clamp shown is as follows:

The lever 9 is first turned into its inoperative position (unless already in said position) and the carrier 4, with the jaw 3 carried by, slid by hand down the handle to space the jaws 2, 3 and the pads thereon sufficiently far apart to suit the thickness of the parts to be clamped.

The device is then offered up to the work to be clamped by holding the device by the handle 1 in one hand and the carrier 4 slid back up the handle in the direction of the arrow A, FIG. 1, so that the pads 20 on the respective jaws 2, 3 engage the parts to be clamped at opposite sides. This upward sliding of the carrier 4 can be effected by propelling the carrier 4 upwards by the thumb of the hand that is holding the handle 1. The user then grips the lever 9 by the same hand as that which is holding the device by the handle 1 and pulls the lever 9 towards the handle 1 into an operative position, for example that shown in broken lines at 9' in FIG. 3, this movement of the lever causing the cam edge 12 to move relatively to the bottom edge 14 of the pivoted jaw 3 to cam against the curved face of the recess 13*a* in the block 13 and cause the block 13 to thrust against said edge 14 against the pressure of the pressure pad 8, said movement of the lever towards the handle thus causing leverage to be exerted on the pivoted jaw 3 to cause the pad 20 thereon to apply clamping pressure firmly against the parts to be clamped, in the direction of the pad 20 on the jaw 2. When the lever 9 reaches a position in which the work is firmly clamped, the hand can be removed from the lever 9 and handle 1, the device then remaining firmly clamped to the work without the device needing to be supported by the hand until the lever 9 is turned back by hand to its inoperative position. The above-described operation of firmly clamping the work results also in the carrier 4 becoming firmly pressed or jammed against the handle 1, whereby the carrier cannot then be manually displaced downwards along the handle until the lever 9 is turned back towards its inoperative position. The arrangement of the cam is such that the lever 9, when in an operative position, with the lever sufficiently turned and with the device firmly clamped to the work, will not inadvertently move back to its inoperative position.

Movement of the lever 9 into an operative position to cause the work to be clamped can develop a powerful clamping force of, for example, 100 lbs. between the pads. The gripping power of the device shown is that of a very strong human hand. The elasticity of the pads and of the unit formed by the handle 1 and jaw 2 prevents or reduces the possibility of over-tightening.

The degree of compression exerted on the work by the clamping jaws can be selected, by the operator making appropriate choice of the extent to which he turns the lever 9 towards the handle 1. The device can thus when desired be operated in such a way as to exert only a light clamping pressure in a case where the work is a delicate object.

The device shown constitutes simple, robust and easily operated clamping means operable by one hand, leaving the other hand free, for example to hold, or to adjust, the position of the work. Whilst the device is shown in a position in which the hand is vertical, it may also be used, in appropriate circumstances, in positions to which the handle is inclined or horizontal.

An advantage of the pads 20 of the device shown being of low-friction material is that in a case where the work being clamped comprises two parts which may tend to slide the one over the other, for example two panels of wood with freshly-laid glue between them, the pads 20, during positioning of the device on the work before clamping will tend to slide over the work, rather than to tend to push the parts of the work out of register with each other.

The various parts of the device may be of any other suitable materials. If desired means for frictionally holding the carrier 4, with the parts carried thereby, against sliding from an adjusted position under the action of gravity may be omitted, and the carrier 4 could instead be supported, when in an adjusted position, by the hand of the operator until he moves the lever 9 to carry out the clamping operation. However, it is preferred to provide the device with means for frictionally holding the carrier 4, with the parts carried thereby, against sliding down the handle under the action of gravity, The movable-jaw unit, comprising the pivoted jaw 3, with its pad 20, carrier 4 with moulding 17, and pivoted lever 9, can be slid off the handle 1 and replaced in the reversed position shown in FIG. 5 to enable the device to be used for applying expansive force to inner faces of a workpiece. The pad 20 on the first jaw 2 is provided with a plane surface to engage such work.

There may be provided a kit of parts comprising (a) a pair of movable-jaw units M (FIG. 6) of the same construction as the movable-jaw unit referred to in the last preceding paragraph, (b) a pair of fixed-jaw units of the same construction as the L-shaped unit constituted by the jaw 2, with its pad 20, and the handle 1, and (c) a length of plain straight bar B (FIG. 6). Said kit may be utilised in various ways. For example, one of the movable-jaw units M may be mounted on one of the two fixed-jaw units to form a device assembled as shown in FIGS. 1 to 4 or in FIG. 5. Or, each unit M may be mounted on a respective one of the fixed jaw units to form a pair of such devices. Or, for clamping parts requiring a jaw setting wider than can be obtained using a unit M mounted on one of the fixed-jaw units, both units M can be mounted on the bar B as shown in FIG. 6 and the levers 9 on both units M operated. The flexure of the long bar B is offset by two distinct clamping actions. In establishing a preliminary grip the bar B can be held in one hand and one unit M propelled up to the work by, and the lever 9 of said unit operated by, the same hand as that holding the bar B. After operation of said lever 9 of the one unit M to establish a preliminary grip, the said hand can then be transferred to the other unit M to operate the lever 9 of the latter. The units M can, in a case where expansive force is required, be mounted on the bar B in the reversed relationship shown in FIG. 7. Another alternative arrangement utilising parts of the aforesaid kit is shown in FIG. 8. In this latter arrangement, one of the units M is slidably engaged with the bar B close to one end of the latter and the other end of the bar B is passed through, with a close fit in, a hole H in the top of a work-bench or like surface. The pad 20 of the jaw 3 of said unit M is, in this arrangement, brought down onto a workpiece resting on the bench and the bar B assumes a tilt-jamming attitude in the hole H. Operation of the lever 9 of the unit M causes pressure to be developed on to the workpiece.

I claim:

1. A clamping or gripping device comprising:

a. a handle including an elongated shaft for holding the device in one hand to position it relatively to work to be clamped or gripped;

b. a first elongated jaw mounted on said handle and extending in a direction transverse to said shaft;

c. a carrier slidably mounted on said shaft for movement towards and away from said first jaw, said carrier having a portion thereof in contact with one side of said shaft;

d. frictional resistance means on said carrier and in sliding contact with said shaft to retain said carrier against movement along said shaft under the influence of gravity;

e. a second elongated jaw having a radiused inner end;

f. means mounting said second jaw on said carrier for pivotal movement about an axis and at a position such that the surface of the radiused inner end thereof abuts the side of said shaft, opposite said one side;

g. a lever pivotally mounted on said carrier and having a cam edge face;

h. a thrust block interposed between said cam edge face and said second jaw, said block having a curved face engaging the surface of said cam face and a face slidingly engaging a surface of said second jaw at the side of said pivot axis opposite said radiused inner end; and i. means biasing said second jaw towards said lever;

j. said lever being arranged such that when the device is held by said handle in one hand to position it relatively to the work, said lever is movable by said one hand from an inoperative position in a direction towards said shaft to cause leverage to be exerted, by cam action between said cam edge face and said thrust block against said biasing means, on said second jaw to cause clamping or gripping pressure to be applied against the work in the direction of said first jaw and said portion of said carrier and said radiused inner end of said second jaw to jam against said opposite sides of said shaft, respectively, whereby the carrier cannot be displaced along the shaft until said lever is returned to said inoperative position.

2. A clamping or gripping device according to claim 1 wherein said biasing means is a resilient pressure pad arranged to be compressed by said second jaw as said lever is pivoted and applies leverage to said second jaw.

3. A clamping or gripping device according to claim 1 wherein said frictional resistance means is a plastic element mounted on said carrier and frictionally engaging said shaft.

4. A clamping or gripping device according to claim 1 wherein said first jaw is an integral extension of said handle.

5. A clamping or gripping device according to claim 1 further comprising a terminal part pivotally mounted on each of said first and second jaws for engaging the work to be clamped or gripped, said pivoted terminal parts being angularly movable relative to the respective jaws whereby they are capable of self-alignment relatively to the work.

6. A clamping or gripping device according to claim 5 wherein said terminal parts are of low-friction material.

7. A clamping or gripping device according to claim 1 wherein at least the cam edge face of said lever is of zinc and said thrust block is of aluminum.

8. A clamping or gripping device, comprising:

a. a bar;

b. a carrier slidably mounted on said bar, said carrier having a portion thereof in contact with one side of said bar;

c. frictional resistance means on said carrier and in sliding contact with said bar to retain said carrier against movement along said bar under the influence of gravity;

d. an elongated jaw having a radiused inner end;

e. means mounting said jaw on said carrier for pivotal movement about an axis and at a position such that the surface of the radiused inner end thereof abuts the side of said bar, opposite said one side;

f. a lever pivotally mounted on said carrier and having a cam edge face;

g. a thrust block interposed between said cam edge face and said jaw, said block having a curved face engaging the surface of said cam face and a face slidingly engaging a surface of said jaw at the side of said pivot axis, opposite said radiused inner end; and h. means biasing said jaw towards said lever;

i. said lever being movable from an inoperative position in a direction towards said bar to cause leverage to be exerted, by cam action between said cam edge face and said thrust block against said biasing means, on said jaw to cause clamping or gripping pressure to be applied against the work and said portion of said carrier and said radiused inner end of said second jaw to jam against said opposite sides of said bar, respectively, whereby the carrier cannot be displaced along the bar until such lever is returned to said inoperative position.

9. A clamping or gripping device, comprising:

a. a bar;

b. a pair of carriers slidably mounted on said bar, each said carrier having a portion thereof in contact with one side of said bar;

c. frictional resistance means on each said carrier and in sliding contact with said bar to retain each said carrier against movement along said bar under the influence of gravity;

d. a pair of elongated jaws, each having a radiused inner end;

e. means mounting one of said jaws on each of said carriers for pivotal movement about an axis and at a position such that the surface of the radiused inner end thereof abuts the side of said bar, opposite said one side;

f. said bar being slidably engaged at one side by said radiused inner end of each of said jaws and at the side opposite said one side by a pair of each of said carriers;

g. a pair of levers, each pivotally mounted on one of said carriers and having a cam edge face;

h. a pair of thrust blocks, each interposed between said cam edge face and said jaw on one of said carriers and having a curved face engaging the surface of said cam face and a face slidingly engaging a surface of said jaw at the side of the pivot axis opposite said radiused inner end; and i. means on each carrier biasing said jaw towards said lever, j. each said lever being movable from an inoperative position in a direction towards said bar to cause leverage to be exerted, by cam action between said cam edge face and said thrust block against said biasing means, on said jaw to cause clamping or gripping pressure to be applied against the work and said portion of said carrier and said radiused inner end of said second jaw to jam against said opposite sides of said bar, respectively, whereby the carrier cannot be displaced along the bar until such lever is returned to said inoperative position.

* * * * *